US007870900B2

(12) United States Patent
Dorado et al.

(10) Patent No.: US 7,870,900 B2
(45) Date of Patent: Jan. 18, 2011

(54) SYSTEM AND METHOD FOR CONTROLLING A PROGRESSING CAVITY WELL PUMP

(75) Inventors: Doneil M. Dorado, Missouri City, TX (US); Kelly A. Woolsey, Stettler (CA)

(73) Assignee: Lufkin Industries, Inc., Lufkin, TX (US)

( * ) Notice: Subject to any disclaimer, the term of this patent is extended or adjusted under 35 U.S.C. 154(b) by 329 days.

(21) Appl. No.: 11/941,848

(22) Filed: Nov. 16, 2007

(65) Prior Publication Data

US 2009/0129942 A1 May 21, 2009

(51) Int. Cl.
*E21B 47/00* (2006.01)
*F04B 49/00* (2006.01)

(52) U.S. Cl. ..... 166/250.15; 166/53; 166/369; 166/250.01; 417/20; 417/22; 417/42; 417/43

(58) Field of Classification Search ..... 166/250.15, 166/53, 369, 250.01; 417/20, 22, 42, 43
See application file for complete search history.

(56) References Cited

U.S. PATENT DOCUMENTS 4,076,458 A 2/1978 Jones
4,125,163 A 11/1978 Fitzpatrick
4,145,161 A 3/1979 Skinner
4,318,674 A 3/1982 Godbey et al.
4,389,164 A 6/1983 Godbey et al.
4,661,751 A 4/1987 Werner
4,738,313 A 4/1988 McKee
4,854,164 A 8/1989 Rhoads
4,973,226 A 11/1990 McKee
5,044,888 A 9/1991 Hester, II
5,064,348 A 11/1991 McKee et al.
5,167,490 A 12/1992 McKee et al.
5,251,696 A 10/1993 Boone et al.
5,782,608 A 7/1998 McKee
6,857,474 B2 2/2005 Bramlett et al.
7,212,923 B2 5/2007 Gibbs et al.

*Primary Examiner*—Jennifer H Gay
*Assistant Examiner*—Yong-Suk Ro
(74) *Attorney, Agent, or Firm*—Gary L. Bush; Mark D. Shelley, II; Andrews Kurth LLP

(57) ABSTRACT

A system and method for controlling the speed of a progressing cavity liquid well pump to increase liquid production from a well while avoiding operation of the well in a pumped-off state. A controller controls a variable speed drive to drive a progressing cavity liquid well pump at a set pump speed while measuring well and system parameters indicative of pumping performance and/or liquid production from the well. The set speed of the pump is changed in steps either increasingly or decreasingly by the controller, acting through the variable speed drive, in response to the measured well and system parameters. The controller, responsive to the measured well and system parameters, challenges the set pump speed by varying the set pump speed so as to increase the production from the well while avoiding pump and well operation in a pumped-off state.

21 Claims, 13 Drawing Sheets

Calculate Speed Increase Module

Sand Blow Out Module

SYSTEM AND METHOD FOR CONTROLLING A PROGRESSING CAVITY WELL PUMP

BACKGROUND OF THE INVENTION

1. Field of the Invention

This invention relates generally to controlling the pumping rate of a pump of a petroleum well. Specifically, one or more implementations of the invention relate to controlling the pumping rate of a progressing cavity pump in order to increase liquid production from a petroleum well while avoiding operation of the well in a pumped-off state.

2. Description of the Prior Art

Prior art pumping systems for recovering petroleum from underground formations have generally had pumping capacities in excess of the productivity rate of the petroleum formation. This results in a well state in which the well may be pumped dry, i.e., the well production is pumped off, thereby potentially causing damage to the pumping system.

It is well known in the art to provide control systems, such as those disclosed in U.S. Pat. Nos. 4,973,226; 5,064,348; and 5,167,490, to avoid a pumped-off state in a petroleum well in which oil is pumped from the well through the use of a downhole liquid pump actuated by a rod and reciprocated from the well surface by a prime mover. In addition to these reciprocating sucker rod type of pumps, progressing cavity pumps (PCP) are also presently in use in which a rotor is rotated inside a stator for pumping liquids. Progressing cavity pumps are advantageous, because the initial cost of the installation is low as compared to reciprocating pumps. However, the progressing cavity pump may also cause a pumped-off state resulting in potential damage to the pump. Such pump damage is expensive to repair, because the progressing cavity pump must be removed from the petroleum well.

U.S. Pat. No. 5,782,608 describes a method and apparatus for controlling the speed of a progressing cavity liquid well pump by driving the pump with a variable speed drive while measuring the amount of liquid production from the pump. One or more of the implementations described herein are improvements upon the method and apparatus disclosed in U.S. Pat. No. 5,782,608, which is incorporated herein by reference.

3. Identification of Objects of the Invention

An object of the invention is to accomplish one or more of the following:

Provide a system and method of controlling the pumping rate of a progressing cavity pump in order to increase liquid production from a petroleum well while avoiding operation of the well in a pumped-off state;

Provide a system and method of controlling the pumping rate of a progressing cavity pump by varying the speed of the pump, either upwardly or downwardly, by a variable speed drive while measuring the liquid production rate in order to increase liquid production from a petroleum well while avoiding operation of the well in a pumped-off state;

Provide a system and method of controlling the pumping rate of a progressing cavity pump by varying the speed of the pump, either upwardly or downwardly, by a variable speed drive while measuring the pump efficiency in order to increase liquid production from a petroleum well while avoiding operation of the well in a pumped-off state;

Provide a system and method of routinely challenging the current pumping rate of a progressing cavity pump by varying the speed of the pump, either upwardly or downwardly, by a variable speed drive in order to increase liquid production from the well while avoiding operation of the well in a pump-off state; and Provide a system and method of controlling the pumping rate of a progressing cavity pump by varying the speed of the pump in order to remove sand along with the liquid production;

Other objects, features, and advantages of the invention will be apparent to one skilled in the art from the following specification and drawings.

SUMMARY OF THE INVENTION

The objects identified above, along with other features and advantages of the invention are incorporated in a system and method for controlling the pump speed of a progressing cavity pump in order to increase liquid production from a well while avoiding operation of the well in a pumped-off state. A controller is used to control a variable speed drive which drives a progressing cavity pump at a set pump speed for producing liquid production from the well. A flow measurement device, such as a flow meter, is used to measure the current flow rate of liquid production from the well.

The controller determines the difference between the current flow rate and a previous flow rate and further uses the determined difference to control the set speed of the pump. The controller increases the set pump speed by a step change when the difference indicates an increase in the current flow rate and decreases the set pump speed by a step change when the difference indicates a decrease in the current flow rate. Further, the controller increases the set pump speed by a step change when the difference indicates no change in current flow rate and the set pump speed was previously decreased and decreases the set pump speed by a step change when the difference indicates no change in current flow rate and the set pump speed was previously increased.

In an alternative implementation, a rod speed measurement device is also used to measure the current rod speed of the rotatable rod of the pump. The controller calculates the current pump efficiency as a function of the current rod speed and the current flow rate. The controller determines the difference between the current pump efficiency and a previous pump efficiency and further uses the determined difference to control the set speed of the pump as disclosed.

Additionally, the controller monitors several measured and calculated system parameters, such as rod speed difference, critical torque, torque limiting, low pump efficiency, high production, low production, low rod speed (i.e., low rpm), and no rod speed (i.e., no rpm), in order to detect if the system parameters are outside of their normal bounds. The controller indicates when the system parameters are outside of their normal bounds by setting an alarm or sending an alert. In an alternative implementation designed for sandy wells, the controller is responsive to the rod torque of the rotatable rod for controlling the set pump speed to remove sand along with the liquid production.

BRIEF DESCRIPTION OF THE DRAWINGS

By way of illustration and not limitation, the invention is described in detail hereinafter on the basis of the accompanying figures, in which.

DESCRIPTION OF THE PREFERRED EMBODIMENTS OF THE INVENTION

Figure 1:
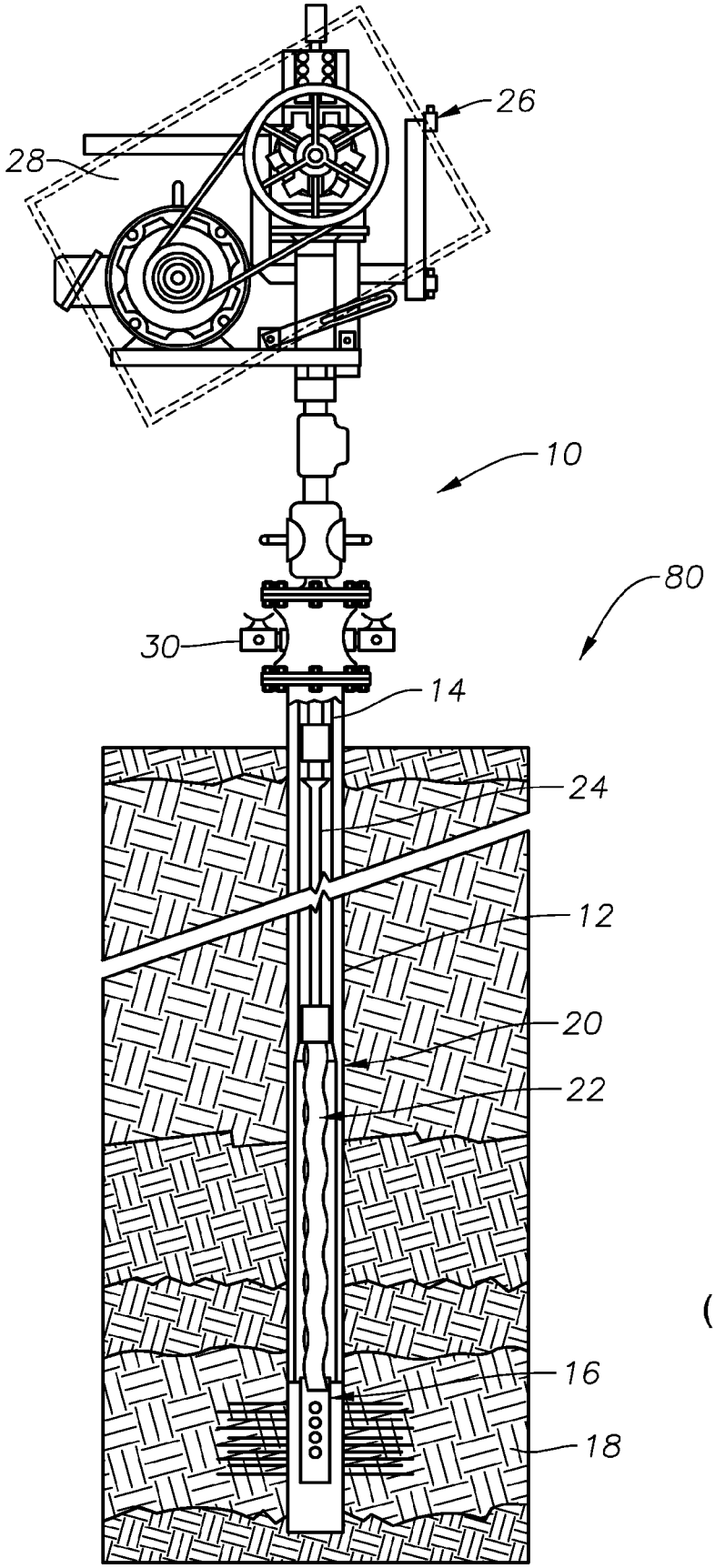
Fig. 1 (Prior Art)
FIG. 1 is a fragmentary elevational view, partly in cross section, illustrating a conventional progressing cavity bottom hole well pump.

A preferred embodiment of the invention alleviates one or more of the deficiencies described in the prior art and incorporates at least one of the objects previously identified. Referring now to the drawings, FIG. 1 illustrates a prior art arrangement of a conventional progressing cavity pump generally shown as reference numeral 10. The conventional pump installation includes a well casing 12, well tubing 14, a tag bar 16 for admitting well liquids from a well production zone 18 into the casing 12. The pump 10 includes a stator 20 connected to the tubing 14 and a rotor 22 connected to a rotatable rod 24. When the rotor 22 is rotated inside the stator 20, cavities in the rotor 22 move axially and a continuous seal between the cavities keeps the well fluid moving upwardly into the tubing 14 at a flow rate which is directly proportional to the rotational speed of the pump 20. The rotor 22 is driven from the surface through a drive assembly 26 driven by a prime mover 28, such as a gas or electric motor or other driving mechanism. Fluid from the well flows out of the flow line outlet 30. Generally, oversized well pumps 10 are installed in order to obtain maximum production. However, pump-off can occur when the pump 10 removes the liquid petroleum faster than the liquid petroleum pools from the formation 18 in the well 80. Continued operation of the pumping system when the well 80 is in a pumped-off state may cause expensive damage to pump 10.

Figure 2:
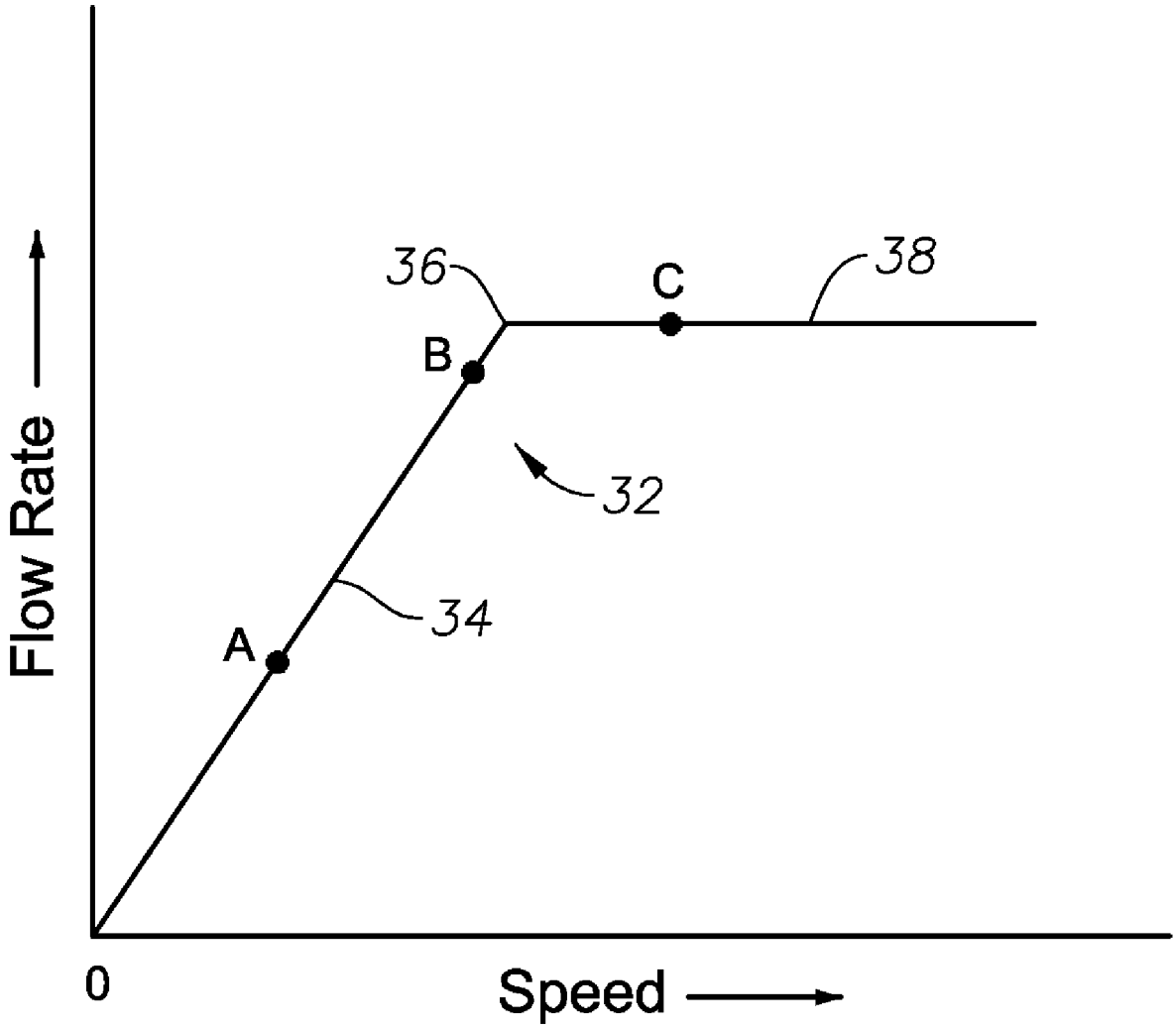
Fig. 2 (Prior Art)
FIG. 2 is a graph of the flow rate of production from the pump of FIG. 2 versus the speed of operation of the pump illustrating the theory of the present invention.

Referring now to FIG. 2, a prior art graph of the flow rate or production pumped by pump 10 (FIG. 1) versus the speed of the pump 10 (FIG. 1), is generally indicated by the reference numeral 32. Graph 32 of FIG. 2, shows that as the speed of the pump 10 (FIG. 1) is increased from zero, the flow rate increases along a linear portion 34 of the graph 32 until it reaches a "knee" 36. After the knee 36, the graph 32 includes a substantially flat portion 38 where an increase in speed does not yield any further increase in well production. That is, when the pump 10 is operating along the line 38, the well 80 may be pumped dry and the pump 10 may be operating in a pumped-off state, resulting in expensive pump damage. The pump 10 may also be operated at point A on the graph 32, but such an operation does not produce the maximum amount of production from the well 80. Preferably, the pump operation should be on the linear portion 34 of the graph 32 near the knee 36, such as at point B. However, pump operation should not occur at point C or along line 38, because the well 80 may be pumped off with continued operation at the indicated flow rate and speed of the pump 10.

Figure 3:
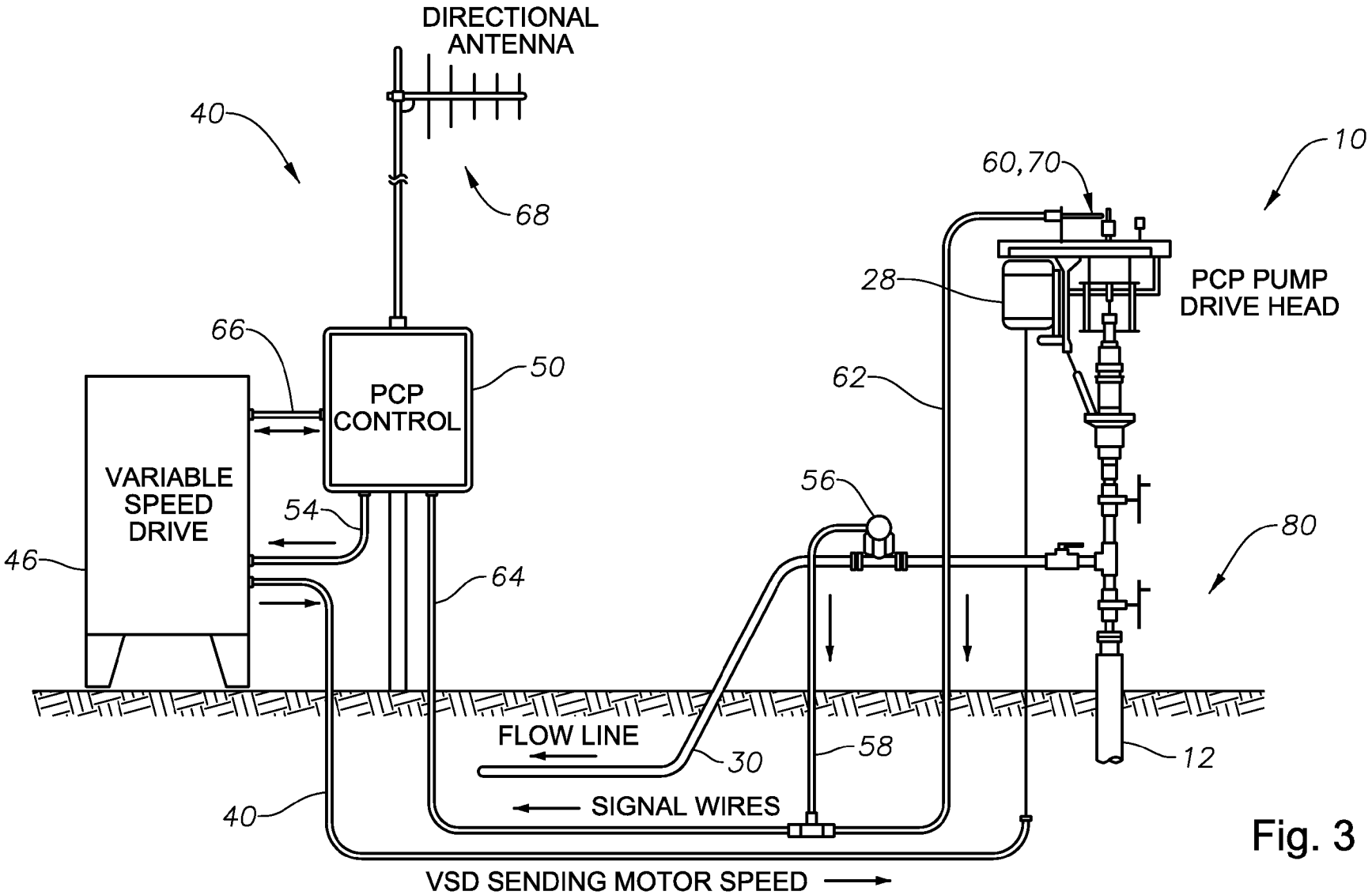
FIG. 3 is a general configuration of a control system for controlling a progressing cavity pump.

Referring now to FIG. 3, a system for controlling a progressing cavity pump 10 according to the invention is generally indicated by the reference numeral 40. A progressing cavity pump controller 50, having a computer processing unit, provides a speed control signal through line 54 to a variable speed drive 46 for controlling the speed of the progressing cavity pump 10. The controller 50 is preferably a progressing cavity pump controller, such as one manufactured by Lufkin Automation of Houston, Tex. The variable speed drive 46 provides a variable frequency drive to the motor 28, such as an induction motor, of the progressing cavity pump 10 for varying the speed of rotation of the rods 24 (FIG. 1). However, other types of control systems and prime movers/motors 28 may be utilized to vary the speed of the rotatable string rod 24. For example, an internal combustion engine (not illustrated) in which the speed is controlled by adjusting its throttle or by adjusting the speed ratio of a gear box could be employed to vary the rod speed. Alternatively, the controller 50 may send a signal to a proportional control valve (not illustrated) on a hydraulic pump application to adjust its pumping capacity.

Preferably, the controller 50 and the variable speed drive 46 are in constant communication with each other through a data interface 66 in order to share system information, such as drive status, motor torque, rod torque, etc. If a torque measurement is not available from the variable speed drive 46, then the torque measurement is monitored and received by controller 50 via an analog input from the drive 46 or from any external torque measurement device 70. The controller 50 also preferably has a communication means, such as an antenna 68, data port for keyboard and display interface (not illustrated), or Internet connection (not illustrated), to communicate controller status, historical data, and system/controller configuration to a local or remote operator.

A flow meter 56, such as a turbine flow meter, is disposed in the flow outlet line 30 from the progressing cavity pump 10 in order to measure the flow rate and amount of liquid produced by the pump 10. The flow meter 56 transmits its measurement signal representative of liquid production flow rate through lines 58 and 64 to the controller 50. A rod string rpm sensor 60 is also provided to measure the speed of the rotating rod 24. The rpm sensor 60 is preferably a hall-effect sensor, however, a theoretical calculation of rod speed may be derived from the readings of other external devices. The rpm sensor 60 transmits its measurement signal representative of rod speed through lines 62 and 64 to the controller 50.

The controller 50 increases or decreases the speed of the primer mover/motor 28, and thus the speed of the pump 10, in varying amounts using the variable speed drive device 46. The controller 50 also receives measurement signals via signal wires 64 from the flow meter 56 representative of the liquid production and/or from the speed sensor 60 representative of the rotation speed of the rotatable rod 24. As previously stated, an objective of varying the speed of pump 10 in response to flow rate and rod speed measurements is to increase liquid production from a petroleum well 80 while avoiding operation of the well 80 in a pumped-off state. In other words, an object of the invention to provide improved control of pump 10 so as to operate and maintain a linear relationship between the liquid production rate and the pump speed (i.e., to operate and maintain the progressing cavity pump 10 on the linear portion 34 of the graph 32 as shown in FIG. 2). Preferably, the pump speed is varied to operate the pump 10 adjacent to the knee 36 of FIG. 2, such as at or near point B, thereby providing optimum well production and avoiding a pumped-off state, which can occur at higher pump speed (i.e., along line 38 of the graph 32).

The controller 50 has a programmable settling period that allows the pumping system to reach a steady state or settle from a previous change in pump speed. After the settling period, the controller 50 commences the averaging of received measurements over a programmable sampling period. As discussed above, the controller 50 preferably receives a pump flow rate measurement from flow meter 56 via line 58 and 64 and a speed measurement from rpm speed sensor 60 via line 62 and 64. Other physical characteristics of the system, such as pressure, temperature, and rod torque, may be directly measured and received by the controller 50 for averaging over the sampling period or for other monitoring purposes. The controller 50 is preferably arranged and designed to use the raw measurements received to calculate additional characteristics of system performance. For example, in one implementation, the controller 50 calculates in real time the pump efficiency as the ratio of actual fluid displacement versus the theoretical fluid displacement. The actual fluid displacement is a calculated quantity comprising measured flow rate and measured pump speed. The theoretical fluid displacement is either calculated based upon the pump specifications or obtained from the pump manufacturer. In this way, the controller 50 can calculate an average pump efficiency over the sampling period based upon direct or indirect measurement of production flow rate and pump speed. Preferably, the controller 50 can receive and average at least one of the following measurements over the sampling period: the amount of production (i.e., flow), the rate of production (i.e., flow rate), and/or the pump efficiency (i.e., a calculated quantity of measured flow rate and pump speed).

Figure 4A:
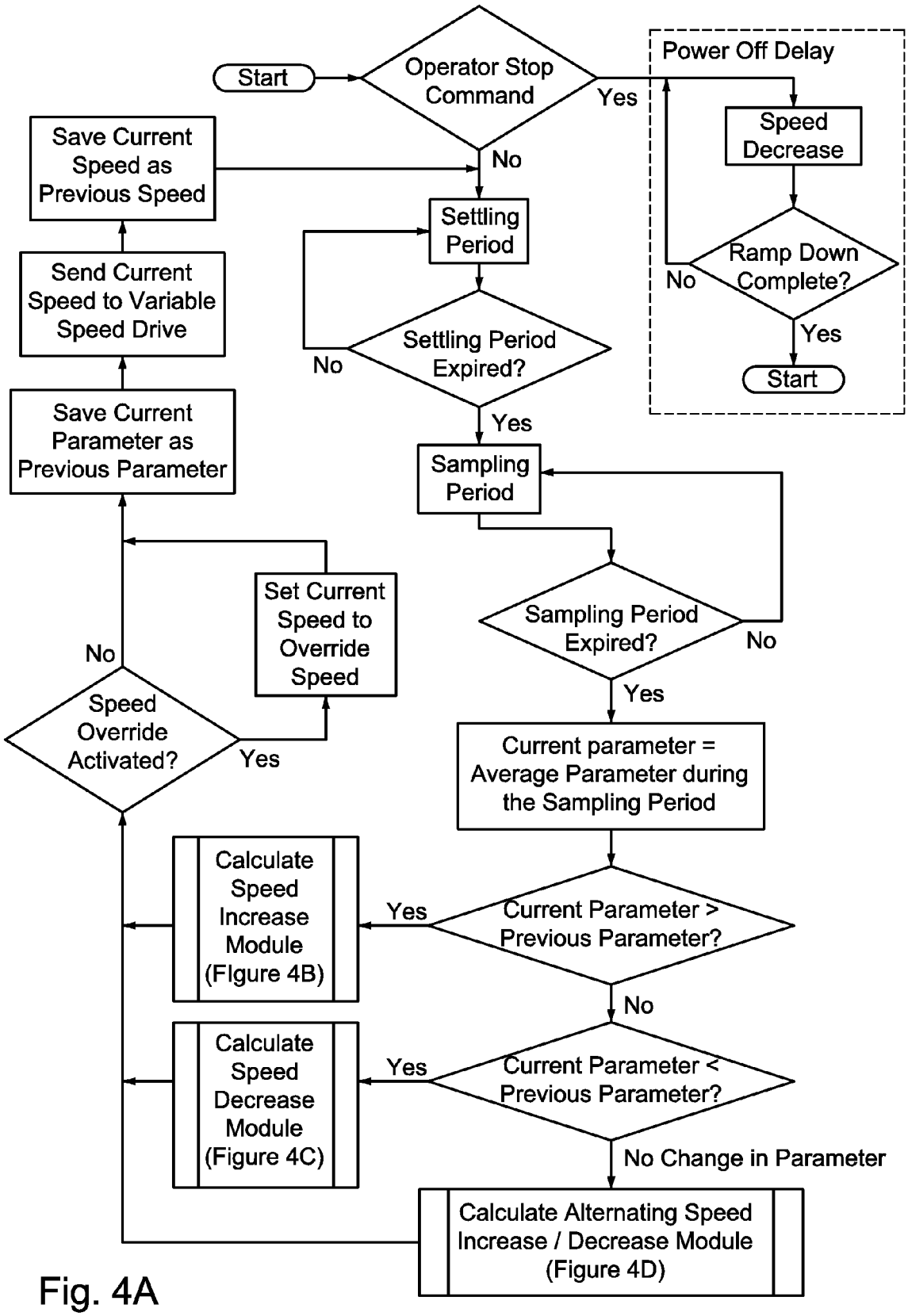
FIG. 4A is a logic flow diagram of one implementation of a control system used in the present invention.

Using the averaged measurements and calculated quantities thereof, the controller 50 directs a change in the motor speed of pump 10 to increase liquid production from the well 80 while avoiding an operation of the pump 10 and well 80 that will lead to a pumped-off well state. FIG. 4A generally illustrates one control strategy that the controller 50 may use to increase liquid well production and avoid well operation in a pumped-off state. At the start, the controller 50 controls a set pump speed for the pump 10 to produce liquid production from the well 80. The pump 10 is operated and controlled at the set pump speed during and for a programmed settling period in order to allow the system 40 to achieve a steady state operation.

After the settling period has expired, the controller 50 receives and averages a measured system characteristic or parameter, such as flow rate measured by flow meter 56, rod speed as measured by rpm speed sensor 60, and/or rod torque as measured by the drive 46 or the rod torque sensor 70. The measurements received by the controller 50 are averaged over the sampling period to filter out any short term variations or outlier readings. The controller 50 may also use any received measurements to calculate the quantities or values of additional characteristics representative of the physical state of the pump 10 and well 80. Solely as an example, and not to limit the scope of possible derivative calculations or system characteristics, the measured flow rate and measured rod speed may be used to calculate a pump efficiency, which is itself representative of the current state of the pump 10 and well 80. The controller 50 then determines the differential value between the averaged measurement or calculated characteristic or parameter over the sampling period and the corresponding measurement or calculated characteristic from the previous sampling period. If no previous sampling period measurement or calculated characteristic or parameter is available, then the controller 50 uses a predetermined value for the previous measurement or characteristic or parameter.

Figure 4B:
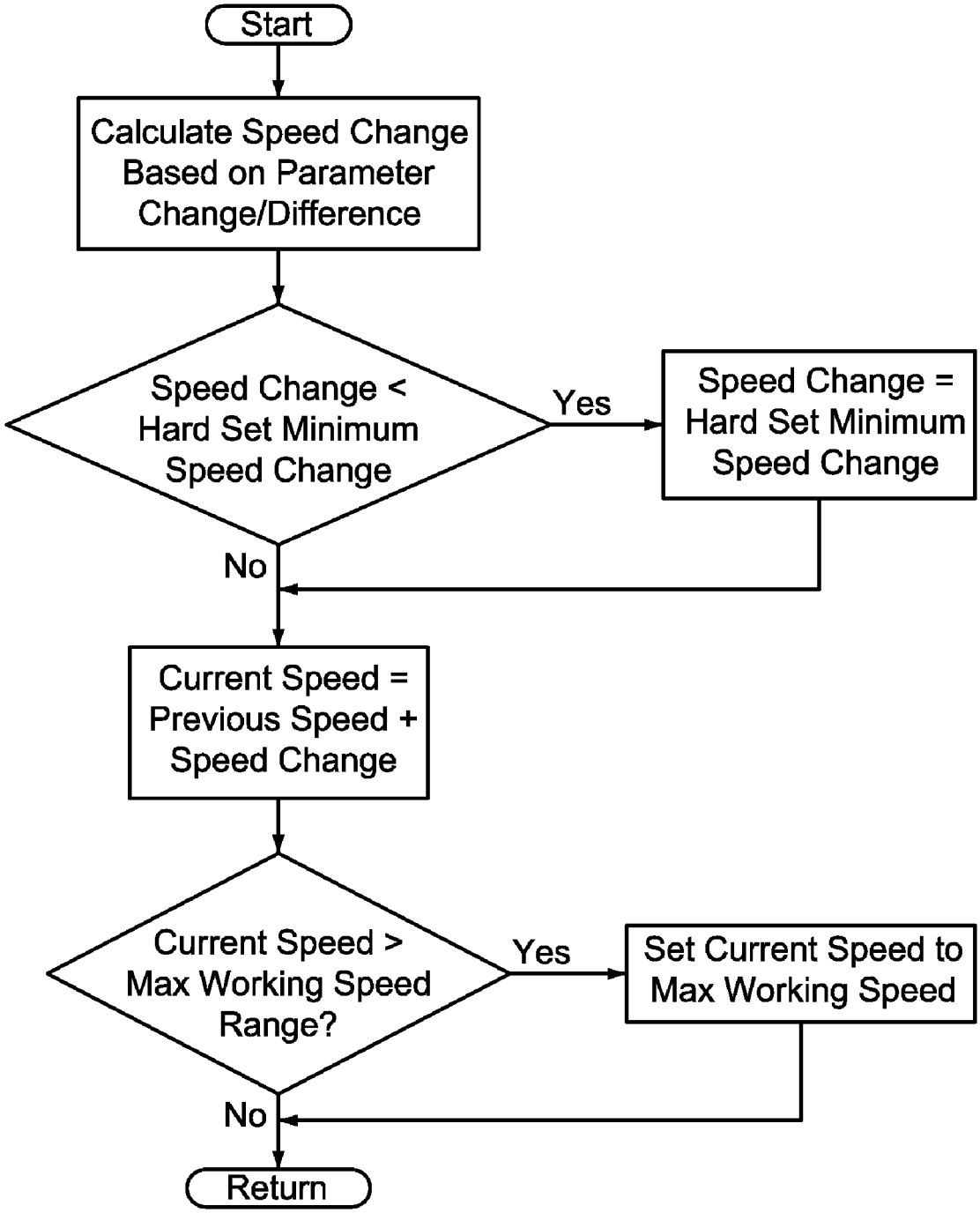
FIG. 4B is a logic flow diagram of a module shown in FIG. 4A used to calculate a speed increase.

If the differential value indicates an increase in production pumped from the well 80, then the controller 50 follows the general control strategy as illustrated in FIG. 4B. The controller 50 sends a signal to the variable speed drive 46 or other pump drive mechanism to increase the set speed of the pump 10 by a step change. The size of the step change is determined by the controller 50 and is generally proportional to the differential value. If the size of the step change determined by the controller 50 is not greater than a minimum step change, then the controller 50 sets the step change increase to be at least the minimum step change. Further, if the step change determined by the controller 50 causes the pump speed to exceed a maximum working speed, then the controller 50 sets the pump speed to be the maximum working speed. Thus, the set pump speed becomes the previous set pump speed plus any controller-determined step change.

Figure 4C:
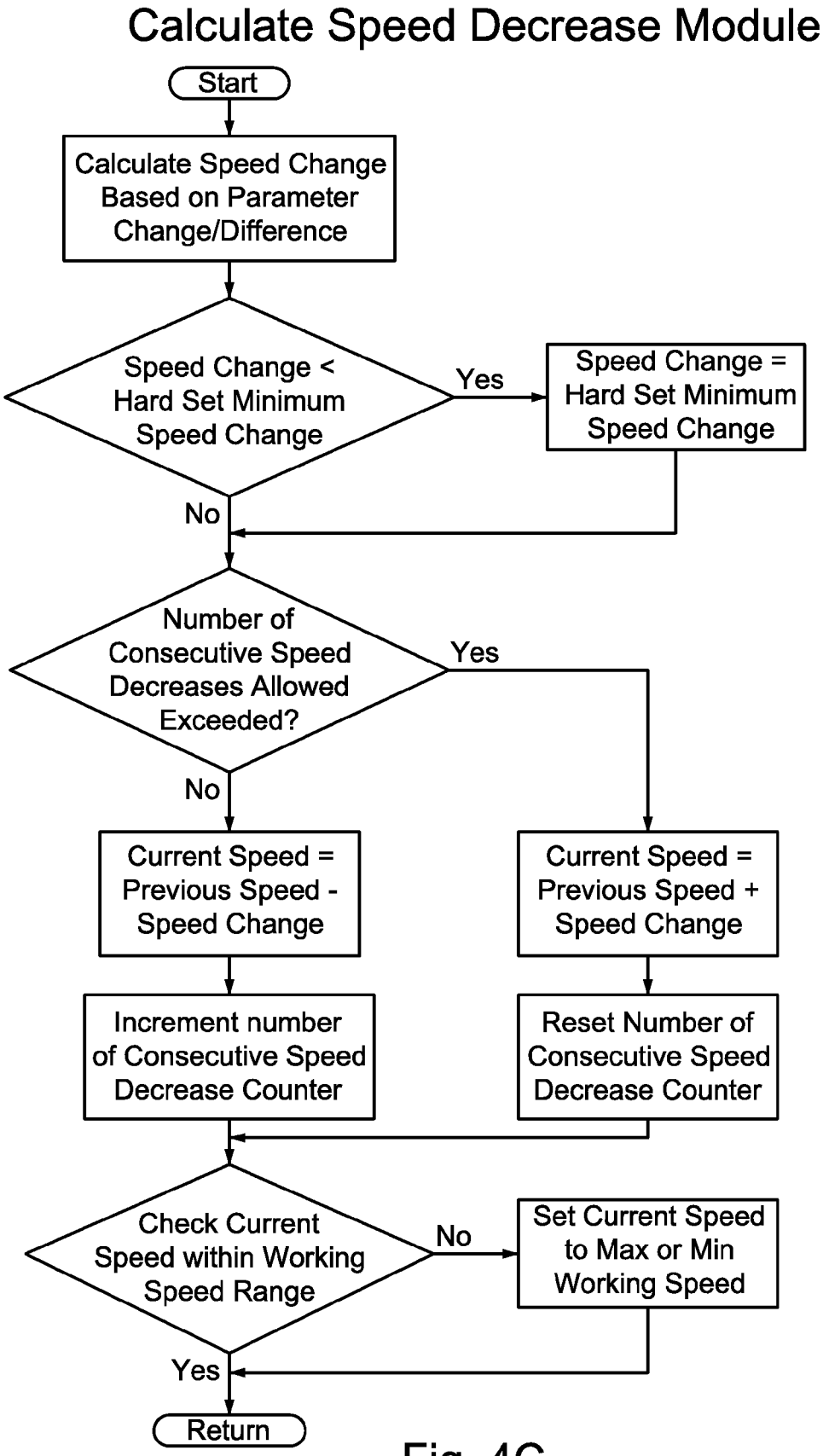
FIG. 4C is a logic flow diagram of a module shown in FIG. 4A used to calculate a speed decrease.

If the differential value indicates a decrease in the production pumped from the well 80, then the controller 50 follows the general control strategy as illustrated in FIG. 4C. As long as the number of consecutive pump speed decreases has not been exceeded, the controller 50 sends a signal to the variable speed drive 46 or other pump drive mechanism to decrease the set speed of the pump 10 by a step change. The size of the step change is determined by the controller 50 and is generally proportional to the differential value. If the size of the step change determined by the controller 50 is not greater than a minimum step change, then the controller 50 sets the step change decrease to be at least the minimum step change. Further, if the step change causes the pump speed to be less than a minimum working speed, then the pump speed is set to the minimum working speed. When the number of consecutive pump speed decreases has been exceeded, the controller 50 challenges the desired decrease by increasing the pump speed by a minimum step change. The counter tracking the number of consecutive decreases in pump speed is also reset to zero. Thus, the set pump speed becomes the previous set pump speed plus any controller-determined step change. In this way, the controller 50 varies the pump speed so as to increase the production from the well 80.

Figure 4D:
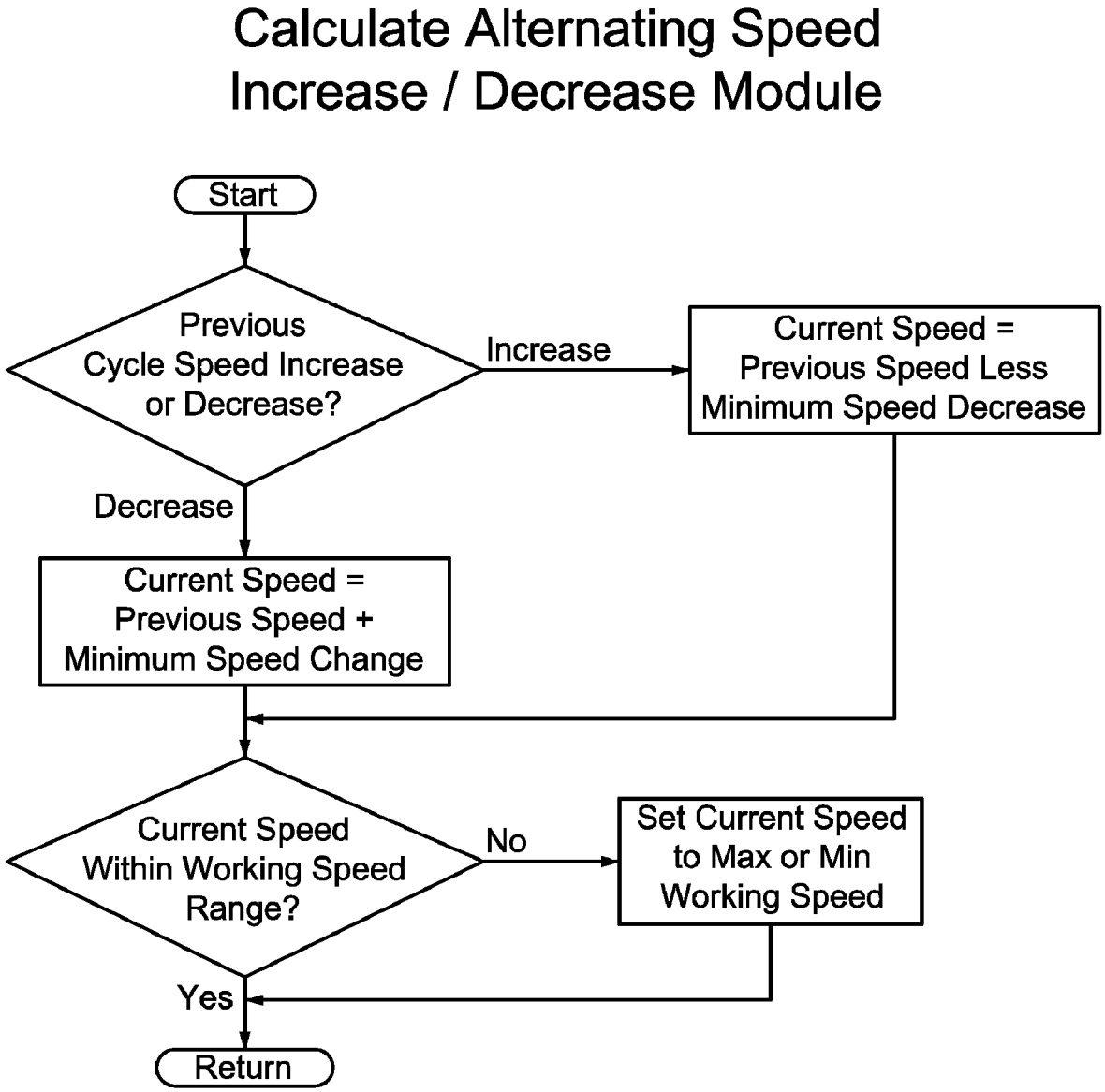
FIG. 4D is a logic flow diagram of a module shown in FIG. 4A used to calculate alternating speed increases and decreases.

If the differential value indicates no change in production pumped from the well 80, then the controller 50 follows the general control strategy as illustrated in FIG. 4D. If the controller 50 decreased the pump speed after the previous sampling period, then the controller 50 sends a signal to the variable speed drive 46 or other pump drive mechanism to increase the set speed of the pump 10 by a minimum step change. If the controller 50 increased the pump speed after the previous sampling period, then the controller 50 sends a signal to the variable speed drive 46 or other pump drive mechanism to decrease the set speed of the pump 10 by a minimum step change. Further, if the minimum step change causes the pump speed to exceed a maximum working or to be less than a minimum working speed, then the pump speed is set to either the maximum or minimum working speed, respectively. Thus, the set pump speed becomes the previous set pump speed plus any controller-determined step change. In this way, the controller 50 challenges the set pump speed by varying the pump speed so as to increase the production from the well 80 while avoiding pump 10 and well 80 operation in a pumped-off state.

After the speed of the pump 10 is set by the controller 50 in response to the differential value, the set pump speed with its step change, is saved as the previous set pump speed for future use by the controller 50 and the averaged system characteristic is also saved as the averaged system characteristic from the previous sampling period. The steps of allowing the system to settle at the set pump speed, measuring and averaging system characteristics, determining a difference in the averaged system characteristics between the current and previous sampling period, and adjusting the set pump speed in response to the determined difference are then repeated to increase liquid production from the well 80 and avoid operation of the well pump 10 in a pumped-off state.

Figure 5A:
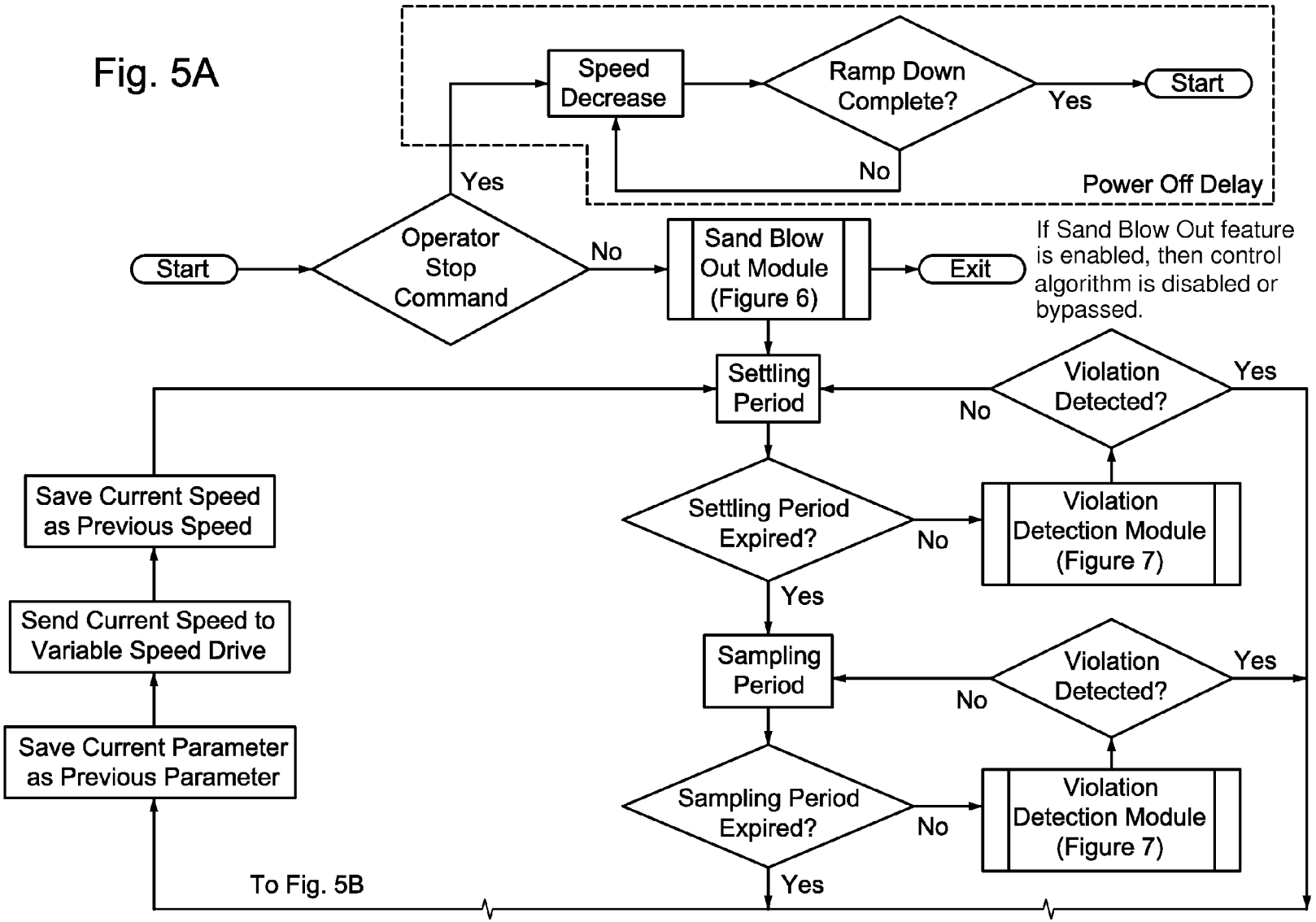
FIGS. 5A and 5B show a logic flow diagram of an alternative implementation of a control system used in the present invention.
Figure 5B:
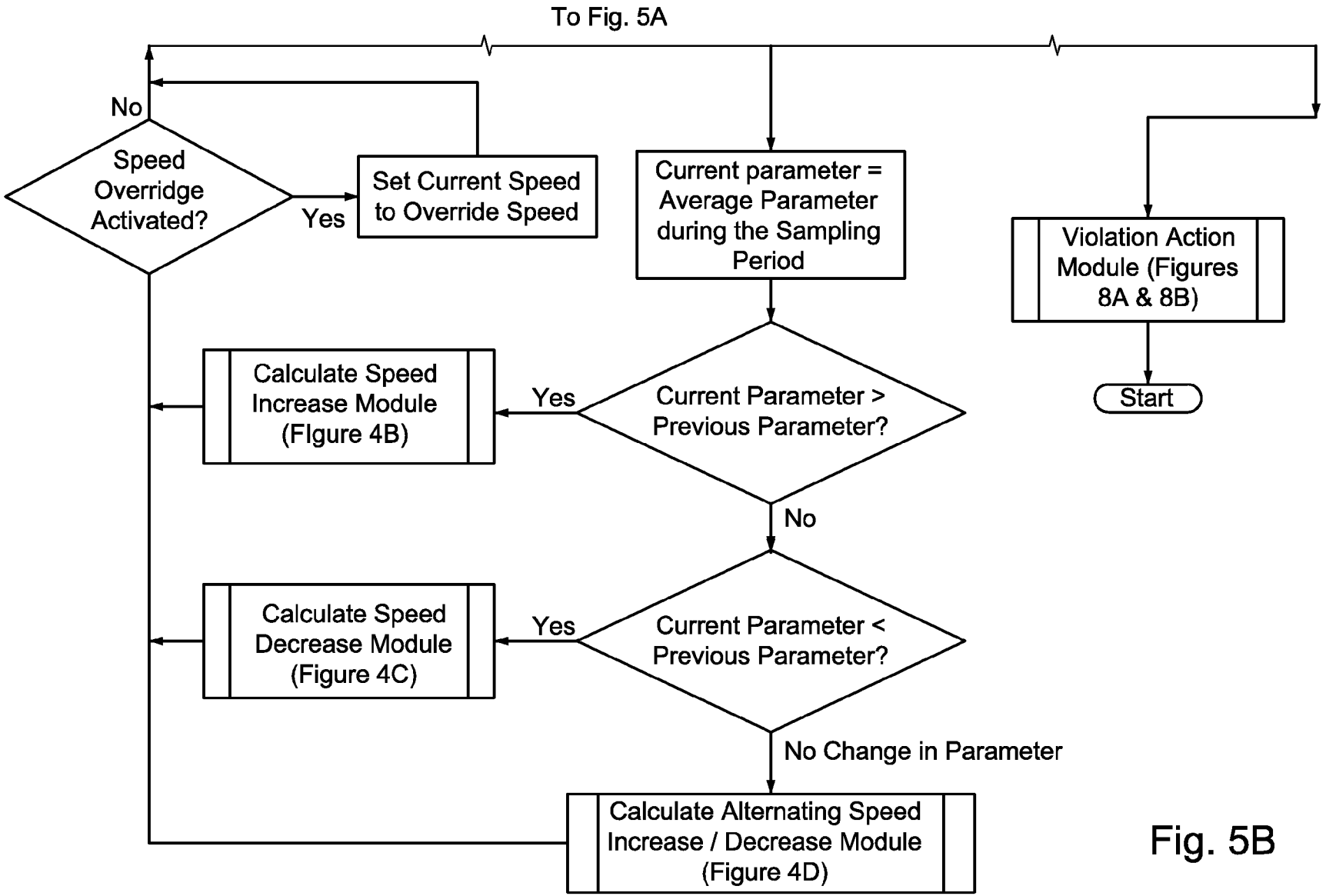
Figure 6:
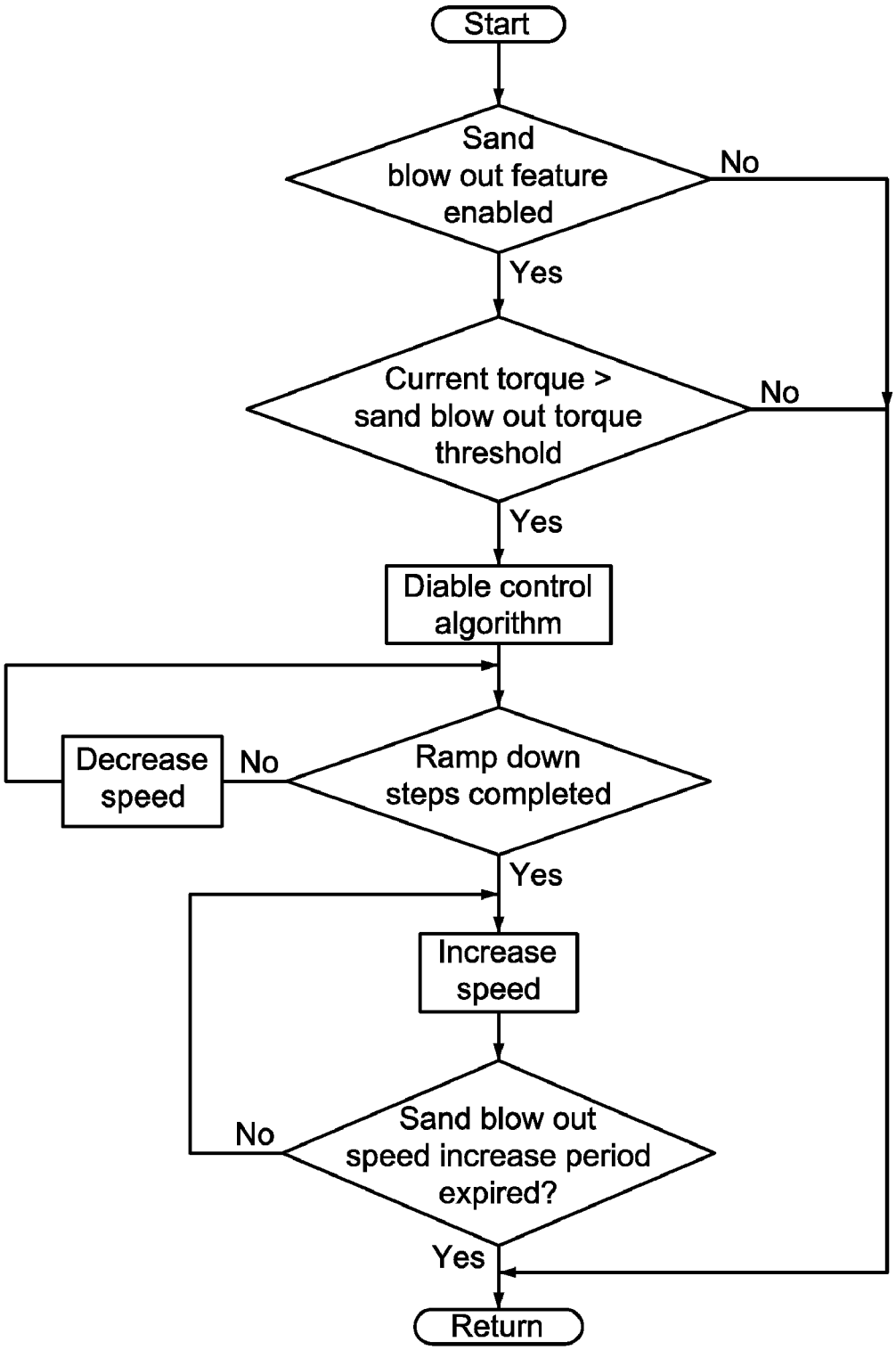
FIG. 6 is a logic flow diagram of a module shown in FIG. 5A used to produce sand along with liquid production.
Figure 7:
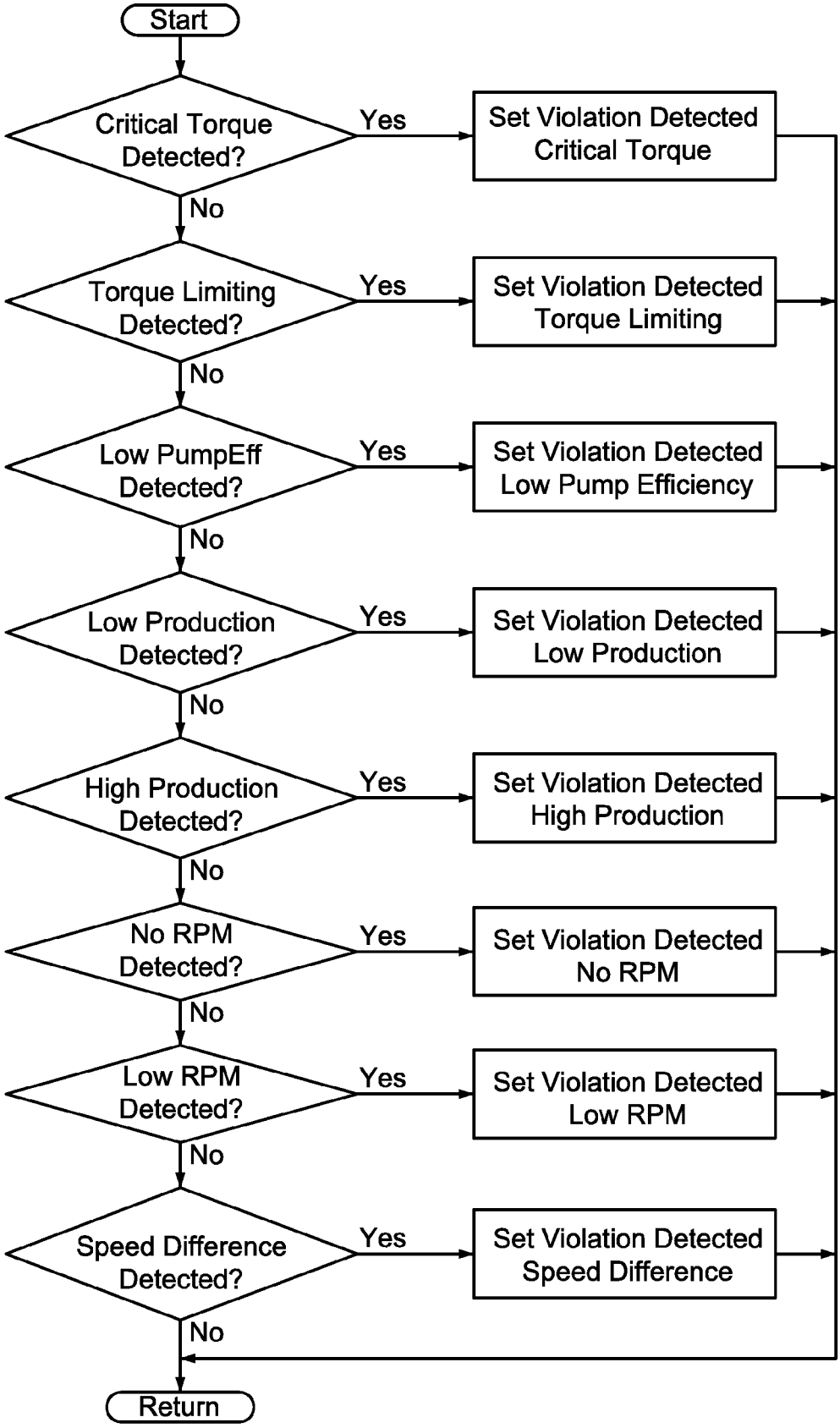
FIG. 7 is a logic flow diagram of a module shown in FIG. 5A used to detect a parameter violation.
Figure 8A:
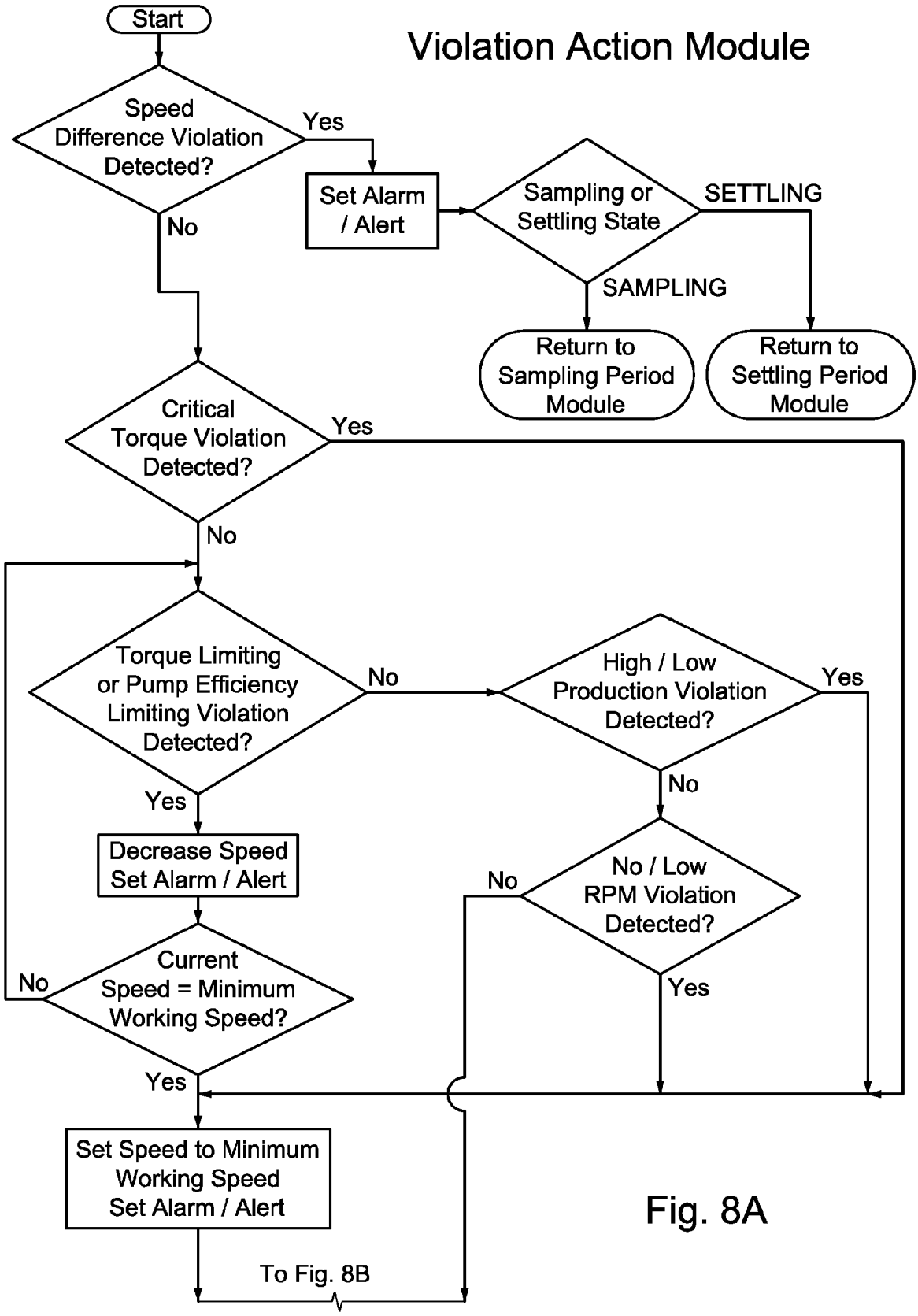
FIGS. 8A and 8B show a logic flow diagram of a module shown in FIG. 5B used to take action upon a detected parameter violation.
Figure 8B:
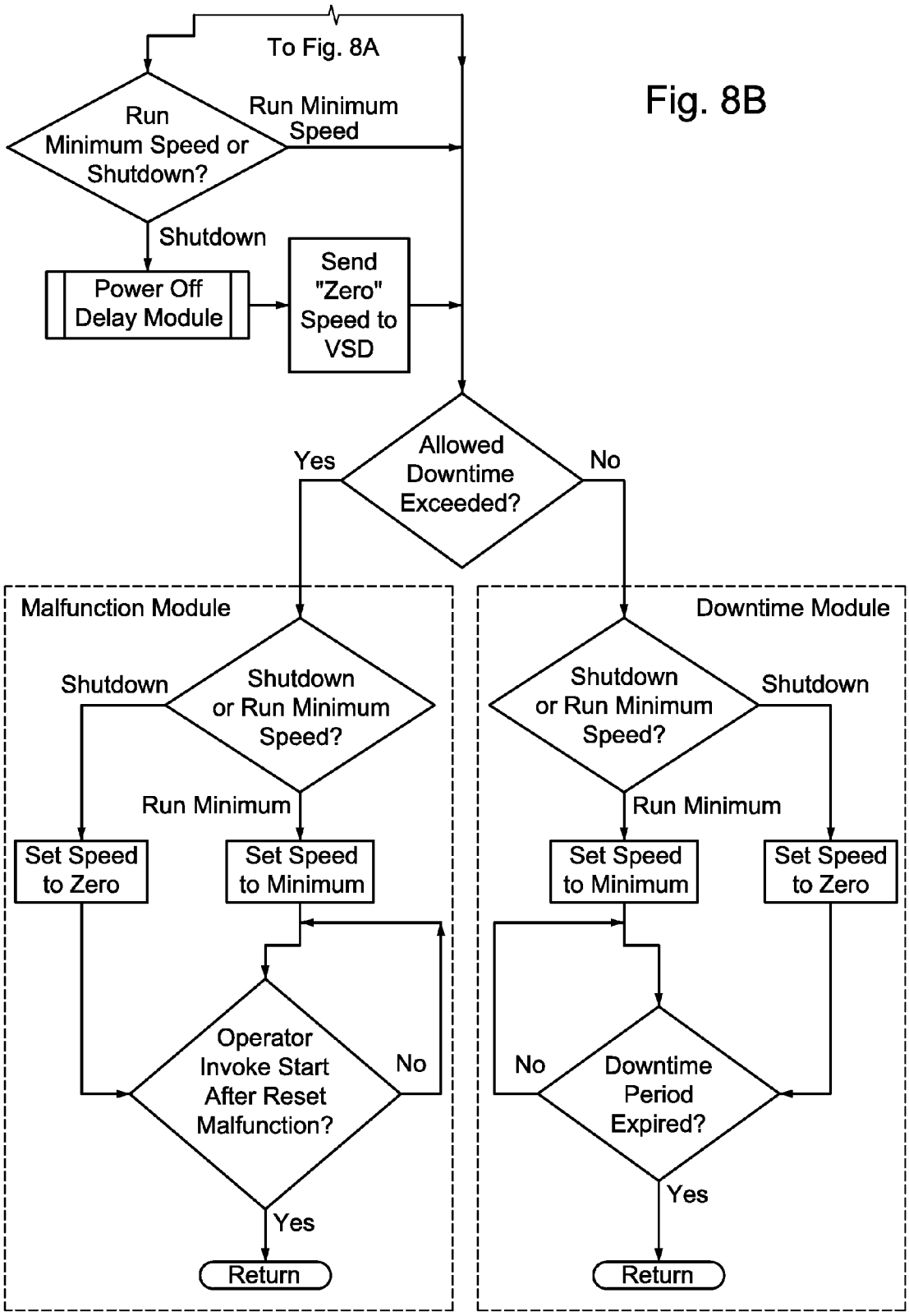

FIGS. 5A and 5B illustrate an alternative implementation of the control strategy of FIG. 4A that optionally includes additional features, such as a sand blow out module (FIG. 6) and parameter violation modules (FIGS. 7, 8A and 8B). The general control strategies, as illustrated in FIGS. 4B, 4C, and 4D, for increasing well production while avoiding a pumped-off well state also apply to the alternative implementation of the control strategy of FIGS. 5A and 5B. Therefore, only the additional features of the alternative implementation will be discussed hereinafter.

As best illustrated in FIG. 6, the sand blow out module is an operator selectable (i.e., enabled/disabled) control strategy that is utilized at the start up of the pump 10 and controller 50 in order to remove sand along with the liquid production. The sand blow out feature is especially helpful in wells with a history of being sandy. In such wells, the sand causes an increase in the torque required to drive the pump. The sand blow out control strategy removes the sand by initially slowing down the speed of the pump 10 to build up enough fluid in the well bore 80. The speed of the pump 10 is then quickly increased to remove the fluid and the sand out of the pump 10 as production. If the sand blow out feature is enabled, the controller 50 monitors the rod torque at the start-up of the pump 10. If the rod torque is greater than the sand blow out torque threshold, then the sand blow out control strategy will be implemented as described above. While the sand blow out feature is disclosed and illustrated as being employed primarily at pump start up, it may be similarly utilized at any time during operation of the pump 10.

While the controller 50 seeks to operate the pump 10 at a speed to optimize liquid production from the well 80, the controller 50 of an alternative implementation of the control strategy also includes an extensive violation detection module and violation action module for monitoring system characteristic or parameters received and processed by the controller 50. The violation detection and violation action modules serve to challenge the current operating speed of the pump in order to prevent the possibility of erroneous or misleading input measurement data. The parameter violation detection module is illustrated in FIG. 7. During the settling and sampling periods, the controller 50 monitors several system measurements, characteristics, or parameters to determine if any are outside of their normal bounds. For example, the controller monitors speed differences between the rod speed represented by the measurement signal from speed sensor 60 and the set pump speed as a feedback control loop to determine any speed inconsistencies indicative of belt slippage. In addition to monitoring rod speed for potential belt slippage, the controller 50 also monitors other system violations and/or malfunctions, such as critical torque, torque limiting, low pump efficiency, high production, low production, low rod speed (i.e., low rpm), and no rod speed (i.e., no rpm).

As shown in FIG. 7, if a monitored parameter is detected to be outside of its normal bounds or range of values (i.e., the controller detects a parameter violation), then the controller 50 reports the parameter violation and preferably begins the violation action procedure. The violation action steps are illustrated in FIGS. 8A and 8B and are described as follows. If a speed difference violation is detected, the controller 50 sets an alarm or sends an alert to notify the operator of the speed difference. The controller 50 then returns to monitor parameters during either the settling or sampling periods as shown. If no speed difference violation is detected, then the controller 50 determines if a critical torque violation is detected. If yes, then the controller 50 sets the pump speed to a minimum working speed and sets an alarm or sends an alert to notify the operator of the critical torque violation. If no critical torque violation is detected, then the controller determines if either a torque limiting or low pump efficiency violation is detected. If yes, then the pump speed is decreased by successive step changes until either the torque limiting or low pump efficiency violation is no longer detected or the pump speed is set to the minimum working speed. If no torque limiting or low pump efficiency violation is detected, then the controller 50 determines if a high or low production violation is detected. If yes, then the controller 50 sets the pump speed to a minimum working speed and sets an alarm or sends an alert to notify the operator of the high or low production violation. If no high or low production violation is detected, then the controller 50 determines if a no or low rpm violation is detected. If yes, then the controller 50 sets the pump speed to a minimum working speed and sets an alarm or sends an alert to notify the operator of the no or low rpm violation. If a no or low rpm violation is not detected, then the controller 50 determines whether the allowed downtime has been exceeded, as described below. If any of the aforementioned violations are detected and the controller 50 responds by setting the pump speed to a minimum working speed, the controller 50, as programmed, then determines whether to continue operation of the pump at the minimum working speed or to shut down the pump. If selected, the shutdown procedure includes a power off delay as shown in FIG. 8B, which is similar to the power off delay modules illustrated in FIGS. 4A and 5A.

As shown in FIG. 8B, the controller 50 continues to monitor the downtime of the pump (i.e., the time the pump is not operating normally). If the allowed downtime is exceeded, then the controller 50 follows the steps shown in the malfunction module of FIG. 8B. In the malfunction module, the controller 50, as programmed, determines whether to operate the pump at the minimum working speed or to shut down the pump until an operator resets the malfunction and restarts the controller 50. The controller 50 then restarts or returns to the beginning of its control strategy. If, however, the allowed downtime is not exceeded, then the controller 50 follows the steps shown in the downtime module of FIG. 8B. In the downtime module, the controller 50, as programmed, determines whether to operate the pump at the minimum working speed or to shut down the pump until the downtime of the pump has been exceeded. Once the downtime has been exceeded, the controller 50 restarts or returns to the beginning of its control strategy.

While the violation detection and action modules are illustrated as an integrated part of the alternative control strategy of FIGS. 5A and 5B, e.g., for implementation during the settling and sampling periods, the violation detection and action modules as illustrated in FIGS. 7, 8A and 8B may be implemented to monitor parameters at any and all times during operation of the controller 50 and/or pump 10. Furthermore, the sand blow out module and the violation detection and action modules may be used independently of or in combination with each other.

The Abstract of the disclosure is written solely for providing the United States Patent and Trademark Office and the public at large with a means by which to determine quickly from a cursory inspection the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A method of controlling pump speed of a progressing cavity pump (10) to increase liquid production from a well (80) while avoiding operation of the well (80) in a pumped-off state, said method comprising the steps of:

controlling a variable speed drive (46) with a controller (50) to drive said progressing cavity pump (10) at a set pump speed for producing liquid production from said well (80);

measuring a current flow rate of liquid production from the well (80) using a flow measurement device (56) arranged and designed to generate a current flow rate signal representative of current flow rate of liquid production from the well (80) and to transmit said current flow rate signal to said controller (50);

receiving said current flow rate signal in said controller (50);

determining a differential flow rate signal with said controller (50), said differential flow rate signal representative of the difference between said current flow rate signal representative of current flow rate and a previous flow rate signal representative of previous flow rate of liquid production from the well (80);

controlling said variable speed drive (46) with said controller (50) to adjust the set pump speed of the progressing cavity pump (10) in response to the differential flow rate signal, increasing said set pump speed by a step change when the differential flow rate signal indicates an increase in the current flow rate, decreasing said set pump speed by a step change when the differential flow rate signal indicates a decrease in the current flow rate, increasing said set pump speed by a step change when the differential flow rate signal indicates no change in current flow rate and said set pump speed was previously decreased, and decreasing said set pump speed by a step change when the differential flow rate signal indicates no change in current flow rate and said set pump speed was previously increased.

2. The method of claim 1 further comprising the step of:

operating the progressing cavity pump (10) at said set pump speed for a settling period.

3. The method of claim 1 further comprising the step of:

repeating the steps of claim 1 to increase liquid production from the well (80) while avoiding operation of the well (80) in a pumped-off state.

4. The method of claim 3 further comprising the step of:

operating the progressing cavity pump (10) at said set pump speed for a settling period.

5. The method of claim 1 further comprising the steps of:

measuring rod torque of said pump (10) using a rod torque measurement device (70) arranged and designed to generate a current rod torque signal representative of torque of a rotatable rod (24) of said pump (10), said rod torque measurement device (70) coupled to and transmitting said current rod torque signal to said controller (50), said controller (50) arranged and designed to receive said transmitted current rod torque signal; and operating said controller (50) to determine if said current rod torque signal exceeds a sand blow out rod torque threshold signal, said sand blow out rod torque threshold signal being indicative of sand in the liquid production, whereby if said current rod torque signal exceeds said sand blow out rod torque threshold signal, said controller (50) decreases the speed of the pump (10) from said set pump speed to allow liquid to accumulate in the well (80), increases the speed of the pump (10) to produce both the sand and the liquid, and resets the speed of the pump (10) to the set pump speed.

6. The method of claim 1 further comprising the step of:

operating said controller (50) to monitor said current flow rate signal, to detect if said current flow rate signal is outside of its normal bounds, and to indicate when said current flow rate signal is outside of its normal bounds.

7. The method of claim 1 further comprising the steps of:

measuring rod torque of said pump (10) using a rod torque measurement device (70) arranged and designed to generate a current rod torque signal representative of torque of a rotatable rod (24) of said pump (10), said rod torque measurement device (70) coupled to and transmitting said current rod torque signal to said controller (50), said controller (50) arranged and designed to receive said transmitted current rod torque signal; and operating said controller (50) to monitor said current rod torque signal, to detect if said current rod torque signal is outside of its normal bounds, and to indicate when said rod torque signal is outside of its normal bounds.

8. A method of controlling pump speed of a progressing cavity pump (10) to increase liquid production from a well (80) while avoiding operation of the well (80) in a pumped-off state, said method comprising the steps of:

using a controller (50) to control a variable speed drive (46) to drive said progressing cavity pump (10) at a set pump speed for producing liquid production from the well (80);

measuring a current flow rate of liquid production from the well (80) using a flow measurement device (56) arranged and designed to generate a current flow rate signal representative of current flow rate of liquid production from the well (80) and to transmit said current flow rate signal to said controller (50);

measuring a current rod speed of a rotatable rod (24) of said pump (10) using a rod speed measurement device (60) arranged and designed to generate a current rod speed signal representative of current rod speed of said rotatable rod (24) of said pump (10) and to transmit said current rod speed signal to said controller (50);

receiving said current flow rate and current rod speed signals in said controller (50);

using said controller (50) to generate a current pump efficiency signal as a function of said current rod speed signal and said current flow rate signal, said current pump efficiency signal representative of current pump efficiency;

determining a differential pump efficiency signal using said controller (50), said differential pump efficiency signal representative of the difference between said current pump efficiency signal and a previous pump efficiency signal; and using said controller (50) to control the variable speed drive (46) to adjust the set pump speed of the progressing cavity pump (10) in response to the differential pump efficiency signal, whereby said set pump speed is increased by a step change when the differential pump efficiency signal indicates an increase in pump efficiency, said set pump speed is decreased by a step change when the differential pump efficiency signal indicates a decrease in pump efficiency, said set pump speed is increased by a step change when the differential pump efficiency signal indicates no change in pump efficiency and said set pump speed was previously decreased, and said set pump speed is decreased by a step change when the differential pump efficiency signal indicates no change in pump efficiency and said set pump speed was previously increased.

9. The method of claim 8 further comprising the step of:

operating the progressing cavity pump (10) at said set pump speed for a settling period.

10. The method of claim 8 further comprising the step of:

repeating the steps of claim 8 to increase liquid production from the well (80) while avoiding operation of the well (80) in a pumped-off state.

11. The method of claim 10 further comprising the step of:

operating the progressing cavity pump (10) at said set pump speed for a settling period.

12. The method of claim 8 further comprising the steps of:

measuring rod torque of said pump (10) using a rod torque measurement device (70) arranged and designed to generate a current rod torque signal representative of torque of a rotatable rod (24) of said pump (10), said rod torque measurement device (70) coupled to and transmitting said current rod torque signal to said controller (50), said controller (50) arranged and designed to receive said transmitted current rod torque signal; and using said controller (50) to determine if said current rod torque signal exceeds a sand blow out rod torque threshold signal, said sand blow out rod torque threshold signal being indicative of sand in the liquid production, whereby if said current rod torque signal exceeds said sand blow out rod torque threshold signal, said controller (50) decreases the speed of the pump (10) from said set pump speed to allow liquid to accumulate in the well (80), increases the speed of the pump (10) to produce both the sand and the liquid, and resets the speed of the pump (10) to the set pump speed.

13. The method of claim 8 further comprising the step of:

operating said controller (50) to monitor said current rod speed signal, to detect if said current rod speed signal is outside of its normal bounds, and to indicate when said current rod speed signal is outside of its normal bounds.

14. A well pumping arrangement (40) for controlling pump speed of a progressing cavity pump (10), said arrangement comprising:

a variable speed drive (46) coupled to and driving the progressing cavity pump (10) at a set pump speed to produce liquid production from a well (80);

a flow measurement device (56) cowled to an outlet 30 of said rums 10 and arranged and designed to generate a current flow rate signal representative of current flow rate of liquid production from the well (80) and to transmit said current flow rate signal; and a controller (50) coupled to said flow measurement device (56) and receiving said current flow rate signal transmitted by said flow measurement device (56), said controller (50) coupled to and controlling the variable speed drive (46) for driving the progressing cavity pump (10) at said set pump speed, said controller (50) arranged and designed to determine a differential flow rate signal representative of the difference between said current flow rate signal representative of current flow rate and a previous flow rate signal representative of previous flow rate of liquid production from the well (80); said controller (50) controlling the variable speed drive (46) to adjust the set pump speed of the progressing cavity pump (10) in response to the differential flow rate signal, whereby said set pump speed is increased by a step change when the differential flow rate signal indicates an increase in the current flow rate, said set pump speed is decreased by a step change when the differential flow rate signal indicates a decrease in the current flow rate, said set pump speed is increased by a step change when the differential flow rate signal indicates no change in current flow rate and said set pump speed was previously decreased, and said set pump speed is decreased by a step change when the differential flow rate signal indicates no change in current flow rate and said set pump speed was previously increased.

15. The arrangement of claim 14 wherein, said controller (50) is arranged and designed to delay determining said differential flow rate signal until a settling period expires.

16. The arrangement of claim 14 wherein, the controller (50) determines and is responsive to a differential flow rate signal after each step change in pump speed.

17. The arrangement of claim 16 wherein, the controller (50) is arranged and designed to delay determining said differential flow rate signal until a settling period expires.

18. The arrangement of claim 14 further comprising, a rod torque measurement device (70) arranged and designed to generate a current rod torque signal representative of rod torque of a rotatable rod (24) of said pump (10), said rod torque measurement device (70) coupled to and transmitting said current rod torque signal to said controller (50), said controller (50) arranged and designed to receive said transmitted current rod torque signal and to determine if said current rod torque signal exceeds a sand blow out rod torque threshold signal, said sand blow out rod torque threshold signal being indicative of sand in the liquid production, whereby if said current rod torque signal exceeds said sand blow out rod torque threshold signal, said controller (50) decreases the speed of the pump (10) from said set pump speed to allow liquid to accumulate in the well (80), increases the speed of the pump (10) to produce both the sand and the liquid, and resets the speed of the pump (10) to the said set pump speed.

19. The arrangement of claim 14 further comprising, a rod speed measurement device (60) arranged and designed to generate a current rod speed signal representative of current rod speed of a rotatable rod (24) of said pump (10) and to transmit said current rod speed signal to said controller (50), said controller (50) coupled to said rod speed measurement device (60) and receiving said current rod speed signal;

said controller (50) arranged and designed to generate a current pump efficiency signal as a function of said current rod speed signal and said current flow rate signal, said current pump efficiency signal representative of current pump efficiency; said controller (50) also arranged and designed to determine a differential pump efficiency signal representative of the difference between said current pump efficiency signal and a previous pump efficiency signal; said controller (50) controlling the variable speed drive (46) to adjust the pump speed of the progressing cavity pump (10) in response to the differential pump efficiency signal, whereby said set pump speed is increased by a step change when the differential pump efficiency signal indicates an increase in the current pump efficiency, said set pump speed is decreased by a step change when the differential pump efficiency signal indicates a decrease in the current pump efficiency, said set pump speed is increased by a step change when the differential pump efficiency signal indicates no change in current pump efficiency and said set pump speed was previously decreased, and said set pump speed is decreased by a step change when the differential pump efficiency signal indicates no change in current pump efficiency and said set pump speed was previously increased.

20. The arrangement of claim 14 wherein, said controller (50) monitors said current flow rate signal, detects if said current flow rate signal is outside of its normal bounds, and indicates when said current flow rate signal is outside of its normal bounds.

21. A method of controlling pump speed of a progressing cavity pump (10) to increase liquid production from a well (80) while avoiding operation of the well (80) in a pumped-off state, said method comprising the steps of:

using a controller (50) to control a variable speed drive (46) to drive said progressing cavity pump (10) at a set pump speed for producing liquid production from said well (80);

measuring rod torque of said pump (10) using a rod torque measurement device (70) arranged and designed to generate a current rod torque signal representative of torque of a rotatable rod (24) of said pump (10), said rod torque measurement device (70) coupled to and transmitting said current rod torque signal to said controller (50), said controller (50) arranged and designed to receive said transmitted current rod torque signal;

using said controller (50) to determine if said current rod torque signal exceeds a sand blow out rod torque threshold signal, said sand blow out rod torque threshold signal being indicative of sand in the liquid production, whereby if said current rod torque signal exceeds said sand blow out rod torque threshold signal, said controller (50) decreases the speed of the pump (10) from said set pump speed to allow liquid to accumulate in the well (80), increases the speed of the pump (10) to produce both the sand and the liquid, and resets the speed of the pump (10) to the set pump speed;

operating the progressing cavity pump (10) at said set pump speed for a settling period;

measuring a current rate of liquid production from the well (80) using a flow measurement device (56) arranged and designed to generate a current flow rate signal representative of the current rate of liquid production from the well (80) and to transmit said current flow rate signal to said controller (50);

determining a differential flow rate signal using said controller (50), said differential flow rate signal representative of the difference between said current flow rate signal representative of current rate of liquid production and a previous flow signal representative of previous rate of liquid production from the well (80);

using the controller (50) to control the variable speed drive (46) to adjust the set pump speed of the progressing cavity pump (10) in response to the differential flow rate signal, whereby said set pump speed is increased by a step change when the differential flow rate signal indicates an increase in the rate of liquid production, said set pump speed is decreased by a step change when the differential flow rate signal indicates a decrease in the rate of liquid production, said set pump speed is increased by a step change when the differential flow rate signal indicates no change in the rate of liquid production and said set pump speed was previously decreased, and said set pump speed is decreased by a step change when the differential flow rate signal indicates no change in the rate of liquid production and said set pump speed was previously increased; and repeating the steps to increase liquid production from the well (80) while avoiding operation of the well (80) in a pumped-off state.

* * * * *